US005957313A

United States Patent [19]

Bouan

[11] Patent Number: 5,957,313

[45] Date of Patent: Sep. 28, 1999

[54] THEFT PREVENTING DEVICE, PARTICULARLY FOR BOTTLES

[75] Inventor: Bruno Bouan, La Varenne, France

[73] Assignee: Fors France S.A., Saint Maur Des Fosses, France

[21] Appl. No.: 08/973,957

[22] PCT Filed: Jun. 20, 1996

[86] PCT No.: PCT/FR96/00962

§ 371 Date: Jul. 17, 1998

§ 102(e) Date: Jul. 17, 1998

[87] PCT Pub. No.: WO97/00819

PCT Pub. Date: Jan. 9, 1997

[30] Foreign Application Priority Data

Jun. 20, 1995 [FR] France ..... 95 07356

[51] Int. Cl.[6] ..... B65D 55/02

[52] U.S. Cl. ..... 215/215; 215/302; 220/230; 220/284

[58] Field of Search ..... 215/215, 273, 215/274, 302; 220/230, 284, 319

[56] References Cited

U.S. PATENT DOCUMENTS

| | | | |
|---|---|---|---|
| 2,565,891 | 8/1951 | Sherman | 220/230 X |
| 3,025,990 | 3/1962 | Pancrazi | 215/276 |
| 3,961,721 | 6/1976 | Gordon et al. | 220/230 |
| 5,405,037 | 4/1995 | Piron | 220/230 |

FOREIGN PATENT DOCUMENTS

| | | | |
|---|---|---|---|
| 2696999 | 4/1994 | France | 215/215 X |
| 677311 | 8/1952 | United Kingdom | 215/215 X |

*Primary Examiner*—Stephen K. Cronin
*Attorney, Agent, or Firm*—Irving N. Feit; Hoffman & Baron, LLP

[57] ABSTRACT

A theft preventing device for an article having a substantially cylindrical end with a substantially ring-shaped bulge, e.g. a bottle or container. The device comprises a releasable body having a clamping means gripping the cylindrical end when in the closed position, and a locking means for preventing the clamping means from being opened unless a special tool is used. The body comprises of a substantially tubular element with a larger diameter than the ring-shaped bulge, and comprises a member that is movable relative to the tubular element between a closed position in which it defines a cross-section smaller than that of the ring-shaped bulge, and a released position in which it defines a cross-section greater than that of the ring-shaped bulge.

9 Claims, 5 Drawing Sheets

THEFT PREVENTING DEVICE, PARTICULARLY FOR BOTTLES

FIELD OF THE INVENTION

The present invention concerns a theft preventing device, for an article having an essentially cylindrical end with an essentially annular swelling, for example, a bottle or a flask. Such a device is intended to prevent theft from shelves, or to prevent access by unauthorized individuals to dangerous, expensive, or toxic products.

DESCRIPTION OF THE PRIOR ART

In the state of the art, different solutions to protect such articles are known. A first solution, disclosed in French Patent No. 8,615,285 consists of a collar which is integrally connected to a locking plate. This collar forms a loop which can be tightened so that it firmly holds the neck of the bottle. The locking in the narrowed position is ensured by a magnetic lock.

A variant of this solution is described in French Patent No. 9,305,159. The device disclosed in this document concerns a clamp that can be placed around the neck of the bottle and locked in the closed position.

These devices of the prior art also include a component which is capable of interacting with a terminal located at the exit of the buying area. When an article having a theft preventing device is detected by such a terminal, it triggers an alarm signal. Theoretically, only the cashier is able to remove the theft preventing device from the article. In practice, the effectiveness of the devices of the prior art is limited. Indeed, their design results in parts which can be used as a lever arm or they provide a hold which makes it possible, without too much difficulty, to obtain a separation from the bottle. Moreover, the protection means are directly visible and, therefore, it is very easy for a dishonest person to understand how the locking is achieved and to defeat it.

In the state of the art, means for locking bottles, which consist of safety stoppers, have also been proposed.

UK Patent No. 677,311 discloses such a stopper, comprising hooks which are locked by a movable ring. This ring is mechanically locked, and it requires the use of a key to authorize the release of the stopper. This solution does not present a great degree of security because the mechanical locking means provides no resistance against a dishonest person, even if that person has little dexterity, unless a true lock is used, whose cost makes it poorly suited for use in large scale production.

Another patent published in France under FR 2,696,999 describes a locking device comprising locking elements which can be released by the axial displacement of a magnetic core which is controlled by the action of an identification code detector. Such a device is adapted to small-scale production, but not for the systematic security for mass market products. In this case, the margins and unit prices are low which does not make it possible to devote large budgets to security equipment.

The purpose of the invention is to propose a locking device which is resistant to theft, whose manufacturing cost is low, and whose deactivation is very simple and rapid for an authorized operator.

SUMMARY OF THE INVENTION

The purpose of the present invention is to overcome the aforementioned drawbacks by proposing a device which guarantees better resistance to unauthorized unlocking.

Another purpose of the invention is to make the contents of a bottle inaccessible when the device is in place, in particular, by preventing the withdrawal of the stopper.

For this purpose, the device according to the invention comprises a removable body comprising a means which is capable of firmly holding, in the closed position, the cylindrical end and a locking means to prevent the opening of said holding means without the use of a specific tool, characterized in that the body comprises an essentially tubular element having a diameter which is larger than the diameter of the annular swelling which has a device which can be moved with respect to the tubular element between a closed position in which it delimits a section which is less than the section of the annular swelling and an unlocked position in which it delimits a section which is larger than the section of the annular swelling.

According to a first embodiment, the theft preventing device comprises an interior element having at least one protuberance which is directed toward the central axis, and an external tubular element, the two elements being relatively movable along a central axis between a position in which they work in cooperation to push back the protuberance in the direction of the central axis, and an unlocked position in which the exterior element releases the interior element to allow the protuberance to separate radially.

According to a general embodiment, the interior body and the exterior body work cooperatively by means of surfaces which are at least partially conical and which ensure the firm holding of the part of the interior body located below the swelling of the neck when they are axially displaced in the locked position, and which also allow the broadening of this part when they are displaced in opposite directions, where a locking device prevents the axial displacement when it is not deactivated.

Advantageously, the device comprises an interior element having at least one protuberance directed toward the central axis and an external tubular element, the two elements being movable with respect to each other along a central axis between a position in which they work cooperatively to push back the protuberance in the direction of the central axis, and an unlocked position in which the exterior element releases the interior element to allow the protuberance to separate radially.

According to a particular embodiment, the interior element comprises a radially deformable tubular element, having at its bottom end at least one protuberance directed toward the central axis.

According to another embodiment, the interior element has an essentially tubular, radially deformable, part which is extended by longitudinal hooks having at their bottom end a protuberance directed toward the central axis.

Advantageously, the interior element and the exterior element can be locked when they are inserted one into the other, by means of a radially movable metal blade, which can be released due to the action of a magnet.

According to a variant, the interior element and the exterior element can be locked when they are inserted into each other by a locking spring catch.

According to a second embodiment, the device according to the invention comprises an internal tubular element and an external tubular element, the elements being relatively movable, and a resistant strip, one end of which is integrally connected to the exterior element and the other end integrally connected to the interior element; the strip forms a loop having a section which is larger than the annular swelling at rest, and which can be reduced by a relative rotation of the exterior element and the interior element.

According to a particular embodiment, the exterior element and the interior element are also axially movable between a position which allows a relative rotation and a position which prevents the relative rotation.

For example, the exterior element and the interior element present complementary serrations which can prevent rotation when the elements are in the closed position.

The invention will be better understood after the reading of the following description, made with reference to the drawings.

DESCRIPTION OF THE PREFERRED EMBODIMENTS

Figure 1:
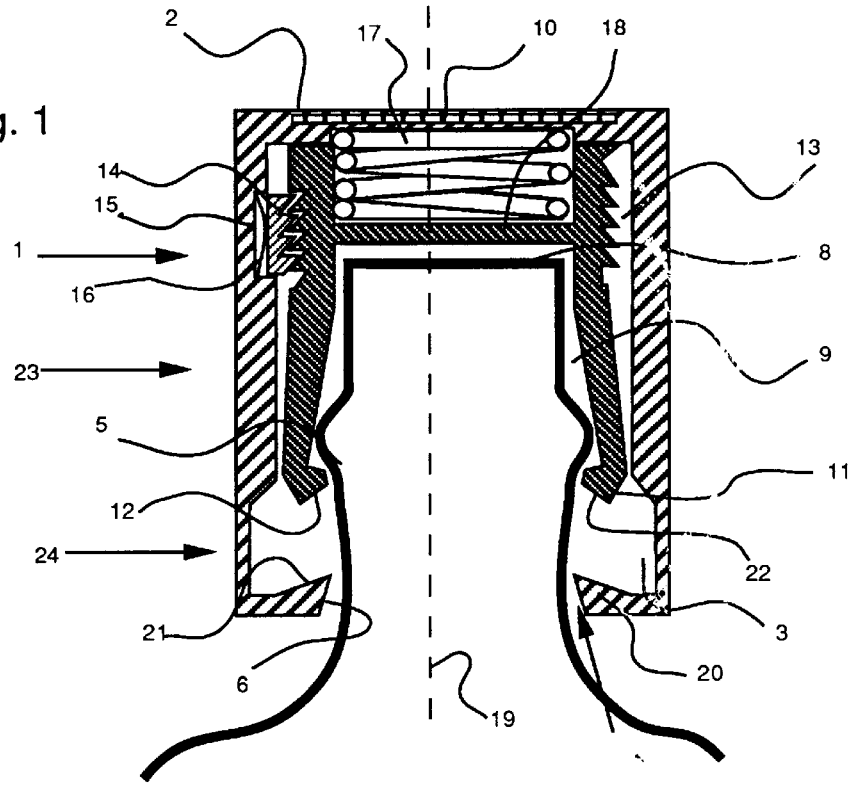
FIG. 1 represents a cross-sectional view of a first embodiment example after it has been placed on the bottle to be protected.

The theft preventing device according to FIG. 1, comprises an external tubular body (1) made of a rigid plastic material or metal. The tubular form is closed at one of its front ends (2) and it has on the opposite front end (3) a circular hole (4). It contains a detection label (10), for example, a radio-frequency or electromagnetic label. This label (10) can be placed in the front or lateral part of the exterior body. It can be included in the material or it can be wedged in a recess which is closed by a sealed internal or external stopper. In the case of an internal stopper, the label becomes inaccessible from the exterior of the device. In the case of an external stopper, the latter can be used as a support for advertisements.

The section of this hole (4) is slightly greater than the section of the annular swelling (5) of the article to be protected, a bottle, in the example described. The edges of the hole (4) present a bevel (6) which converges towards the closed front face (2). This bevel (6) facilitates the placement of the device on the neck of the bottle by guiding the positioning of the front face during the passage of the face (3) over the swelling (5). It also makes it possible to provide a hole (4) having a section which is slightly less than the section of the swelling (5) when the material constituting the tubular body allows a slight elastic deformation.

A second tubular element (7) is accommodated inside the exterior body (1). It has an internal cavity (9) whose depth essentially corresponds to the distance separating the bottom edge of the swelling (5) from the top edge (8) of the neck. At its bottom end, the internal cavity (7) has a choke or narrowing (11), so that, in the locked position, the bottom front end has an opening which is at most equal to the section of the neck below the swelling (5). The edge of this opening also has a bevel (22) forming an angle of approximately 45°, whose edges converge toward the top part of the device.

The top part of the element (2) has annular grooves (13) whose top edges converge toward the bottom, and whose bottom edges are essentially in radial planes. These grooves work cooperatively with a metal part (14), accommodated in a cavity (15) of the external tubular element (1) and pushed back at rest toward the center of the device due to the action of a leaf spring (16). This metal part has complementary grooves so that the two series of grooves allow the insertion of the internal tubular element (2) into the external tubular element (1), without allowing the relative displacement in the opposite direction except when the metal part (14) is retracted, for example, due to the action of the magnetic force of a magnet placed against the external wall of the tubular element (1).

A spring (17), placed between the front face (18) of the interior element and the front face of the exterior element (1) applies pressure so as to separate the two elements along the principal axis (19).

The internal surface of the lower front face of the exterior element (1) has an annular boundary (20) forming a bevel (21) converging toward the top, and capable of working cooperatively with the lower edge having a bevel (22) which is essentially complementary. When tension is applied to the external tubular element (1), the two bevels (21) and (22) engage. The tension has a tendency to radially separate the bottom edge from the interior element, allowing the passage at the level of the swelling (5). The interior element (1) has, at its top part (23), a reduced section so as to prevent the radial broadening of the bottom edge of the interior element. The interior element (1) has, at its bottom part (24), an increased section so as to allow the radial broadening of the bottom edge of the interior element.

When the interior element is inserted in the exterior element (1), it is impossible to withdraw the device, because the section of the bottom edge prevents the passage at the level of the swelling (5). The two elements are maintained in this position by the cooperation between the locking part (14) and the grooves (13). In this position, the internal part (7) and the exterior element (1) have a degree of freedom, but they are locked against translational movement. The exterior element "spins loosely" with respect to the interior element, which prevents a person who attempts to force the device from applying a torque which can destroy the device.

Figure 2:
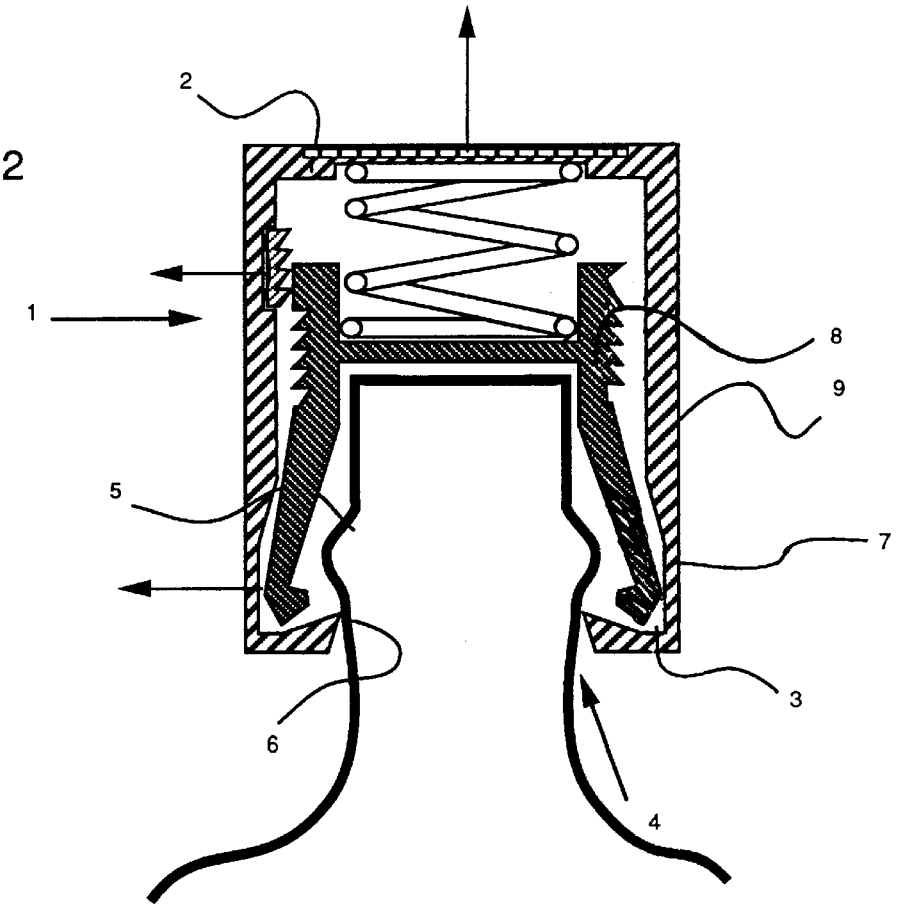
FIG. 2 represents a cross-sectional view of a first embodiment example before it was placed on the bottle to be protected.

In contrast, when the locking part (14) is drawn towards the exterior by means of a magnet, the two elements, the interior element and the exterior element, can move along the axis (19). The spring (17) then relaxes to separate the two elements, the interior element and the exterior element, as shown in FIG. 2.

The two bevels (21) and (22) then come into contact, and when tension is applied to the exterior element (1), the cooperation of the bevels results in the separation of the bottom edge from the interior element, until movement above the swelling (5) becomes possible.

The use is as follows. At rest, the interior element and the exterior element are separated as shown in FIG. 2. The top part of the internal part maintains the locking piece in the separated position.

When the device is placed over the neck of a bottle, the top front part of the interior element comes into contact with the edge of the bottle and it stops the movement of the interior element. One continues to apply pressure against the interior element, which causes the compression of the spring (17). The locking part (14) engages with the grooves (13). When the pressure is released, the locking part (14) blocks the relative translational displacement of the interior element and the exterior element. The unblocking occurs when a magnet is brought close to the wall of the exterior element, at the level of the position of the metal locking part. To facilitate the retraction of the locking part, it is recommended to apply slight pressure against the exterior element (1).

This first embodiment is described as a nonlimiting example. It is possible to achieve the same functions by different means, for example, by replacing the locking part with a metal blade. Similarly, it is conceivable to provide deformable tongues having the same cross section as the bottom part of the interior element, rather than to use a deformable tubular part.

Figure 3:
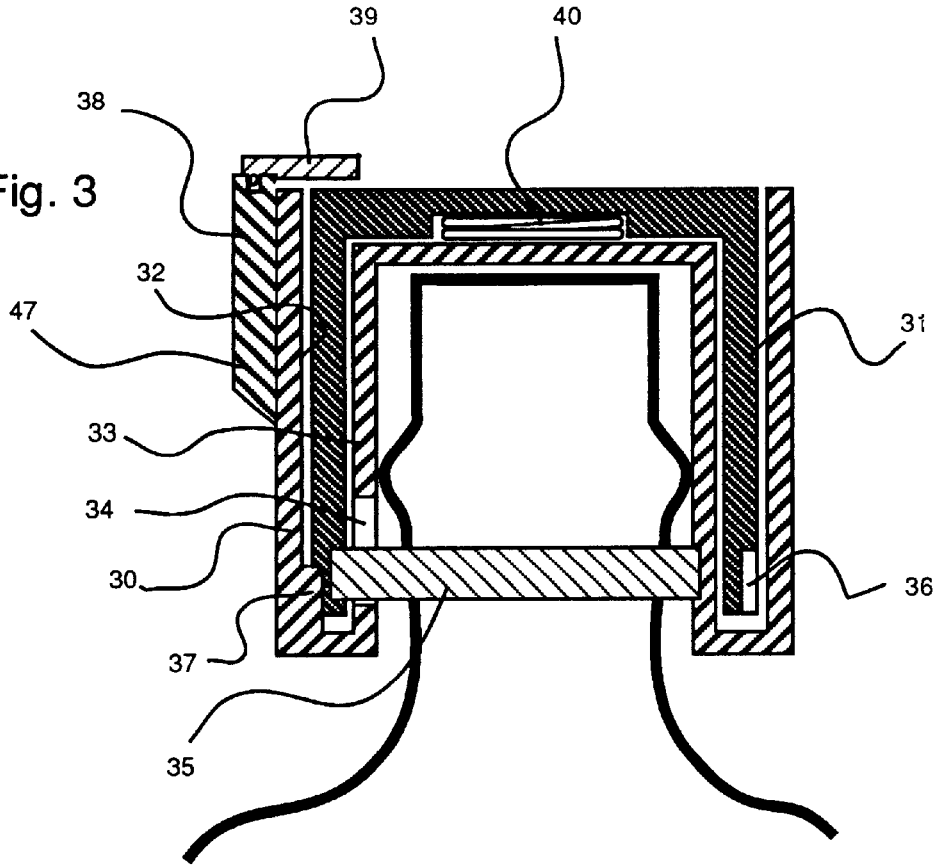
FIGS. 3 and 4 represent an embodiment in the locked position and unlocked position, respectively.
Figure 4:
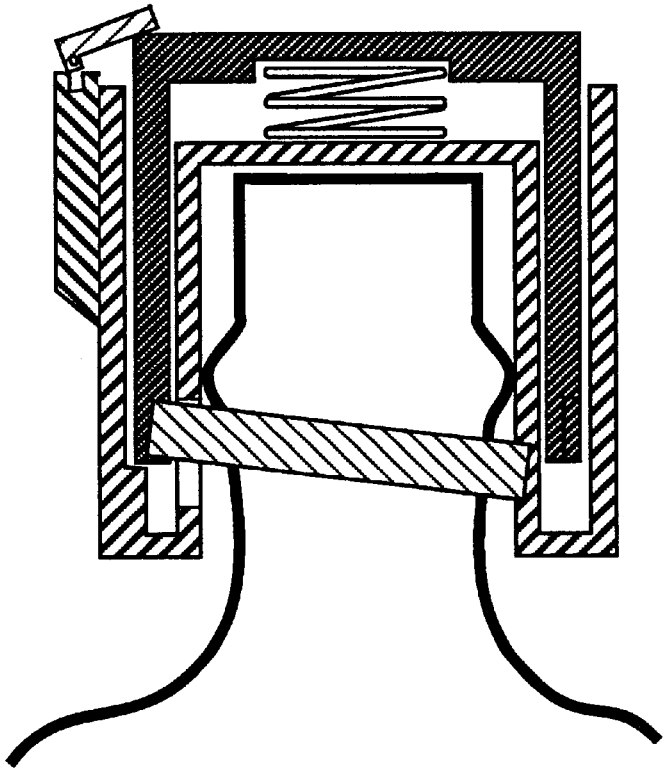

FIGS. 3 and 4 represent an embodiment in the locked position and unlocked position, respectively.

The device according to this embodiment comprises an exterior body (30) with tubular shape and an interior body (31) with tubular shape.

The exterior body (30) has a cylindrical cavity (32) inside of which the interior body (31) is placed. The internal wall (33) has a slit (34). A band (35) made of a flexible and resistant material, for example, a thin sheet of steel or a nylon band, is attached, on the one hand, to the interior body (3 1) and, on the other hand, to the exterior body (30), and it passes through the wall (33) at the level of the slit (34). This band forms a loop which firmly holds the neck of the bottle below the swelling. Notched crowns (36,37), provided on the bottom edge of the interior body and in the bottom of the cavity, respectively, prevent the relative rotation when the two bodies are inserted in each other.

A lock (47), for example, of the type known for protecting cassettes and is integrally connected to the exterior body (30). It comprises a movable spring catch (38) which prevents, in the locked position, the relative displacement of the two bodies along the longitudinal axis.

When the lock is released, as shown in FIG. 4, a spring (40) tends to separate the two bodies (30,31). The serrated crowns (36,37) are then decoupled and it becomes possible to turn the interior body with respect to the exterior body. In this way, one expands the band (35), and the loop which forms enlarges until it allows passage of the swelling (5).

To place the device, the exterior body is turned with respect to the interior body so as to enlarge the loop formed by the band. The device is then placed over the neck of the bottle and the interior body, which has a knurled base (48), is turned until the band is locked. One then applies pressure to the interior body to engage the grooves, and one closes the spring catch.

The unlocking is carried out using a standard tool used for antitheft devices for cassettes, for example. The spring catch is released, and the interior body is ejected due to the action of the spring. One can then release the band by rotation of the interior body and pull the device off the neck of the bottle.

Figure 5:
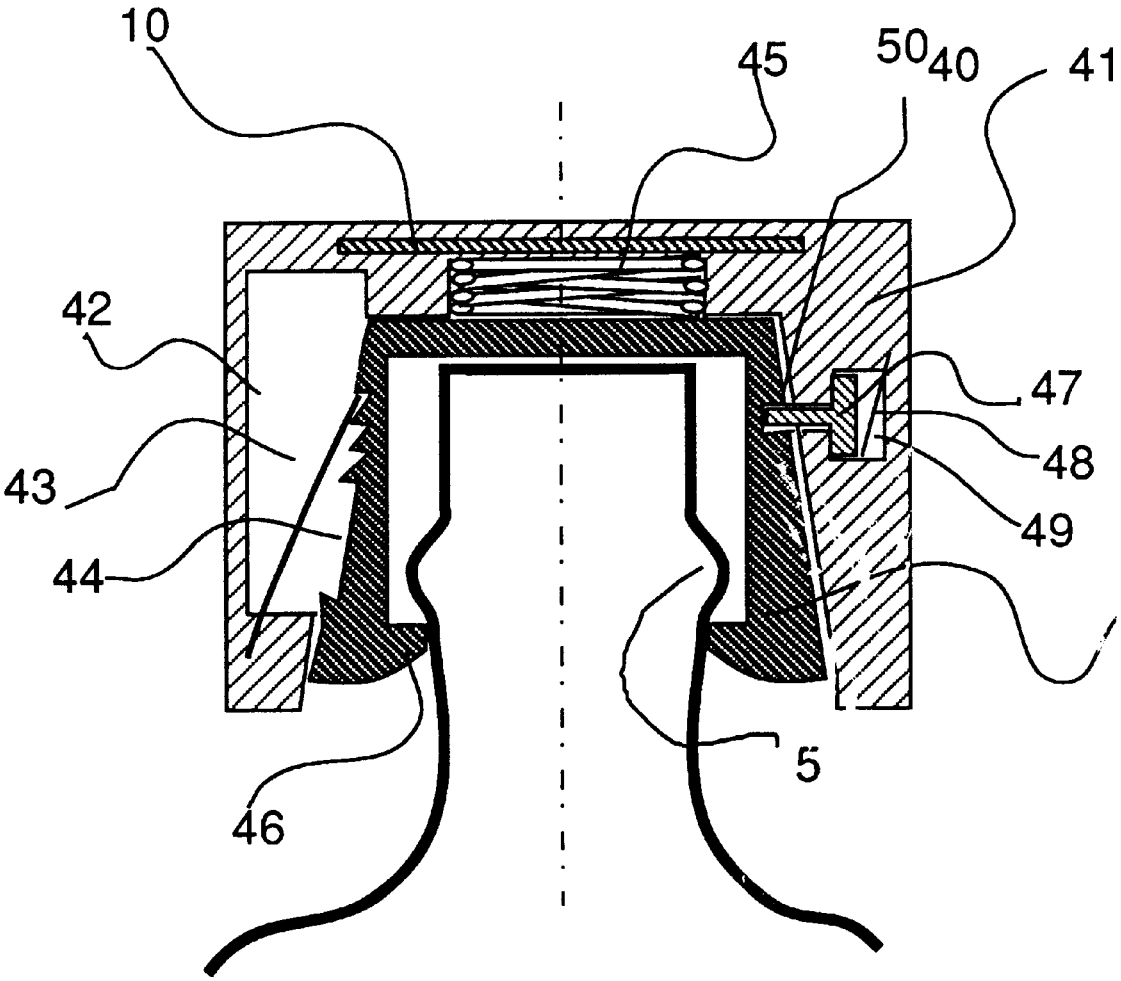
FIG. 5 represents a third embodiment.

FIG. 5 shows a third embodiment. The interior body (40) is conical, with lateral walls converging to the top. The exterior body has a conical cavity having a complementary shape. In the wall, a longitudinally oriented cavity (42) is provided, having the width of a blade (43) which can be attracted by a magnet. The end of this blade works cooperatively with the teeth (44) or the annular grooves provided on the surface of the interior body. At rest, the blade engages in the teeth to prevent the relative displacement of the two bodies (40,41) along the longitudinal axis. When the blade (43) is attracted by a magnet placed in proximity of the wall, the spring (45) tends to separate the bodies axially, and the lips (46) provided on the internal surface of the body (42) can separate to allow passage at the level of the swelling (5). An abutment, not shown, limits the relative movement of the two bodies and it makes possible to apply tension to the exterior body to force the passage at the level of the swelling.

The right part of the figure has a locking variant, which uses a metal mass head (47), accommodated in a cavity (49), provided in the wall of the exterior body. An elastic blade (48), at rest, laterally pushes the head back toward the interior so that its end comes to be located in an annular groove (50) provided on the external surface of the interior body. In this embodiment, the two bodies spin loosely in the locked position, which makes it difficult to force the theft preventing device.

Figure 6:
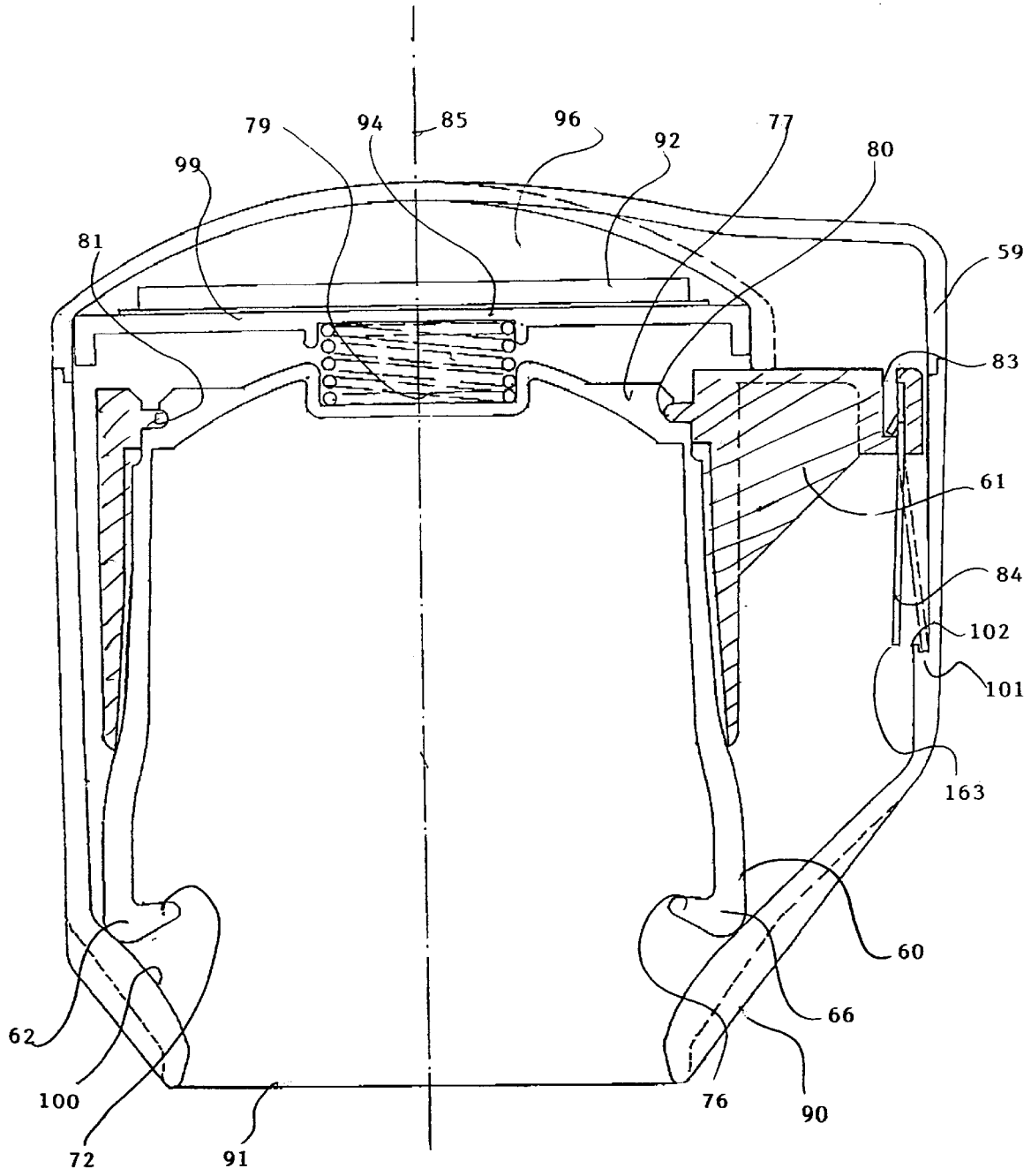
FIG. 6 represents a cross section of another embodiment of the invention.
Figure 7:
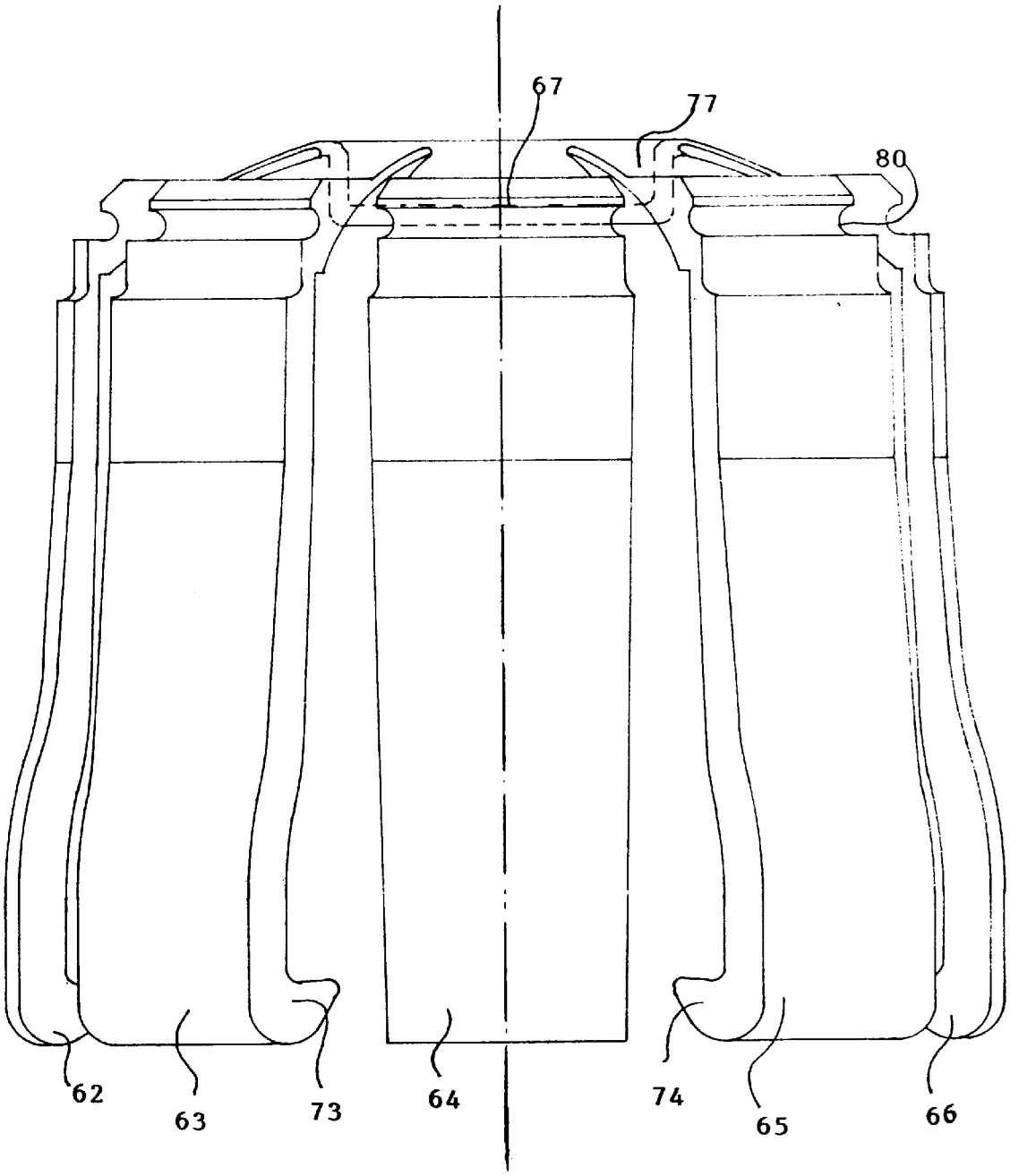
FIG. 7 represents a perspective view of the clamp of said embodiment in enlarged scale.

FIGS. 6 and 7 refer to a preferred embodiment.

The theft preventing device comprises three principal parts: a clamp (60), a clamp support (61) and an external housing (59). These parts can be made of a molded plastic.

The clamp, of which one is shown in a perspective view in slightly enlarged scale in FIG. 7, has the general shape of a bell. The clamp (60) has a plurality of lateral fingers (62–66), each having a radial protuberance (72–76), directed toward the interior of the part. These lateral fingers (62–66) are separated by free intervals and they are combined by a disk-shaped bottom (77). This disk-shaped bottom (77) has a housing (78) which is cylindrical in shape and in which the end of a spring (79) comes to be located. The fingers (62–66) have a certain elasticity which make it possible to slightly separate the ends opposite the disk-shaped bottom (77), in a radial direction, either to tighten the protuberances (72–77) or to separate them.

This clamp (60) also has, on the top part, an annular groove (80) which ensures the connection with the clamp support (61).

The clamp support (61) is made of a molded plastic material having an essentially cylindrical shape and having, on its top part, inside the cylindrical cavity, an annular protuberance (81) which by applied force engages with the groove (80). The clamp support (61) also has a lateral extension (82) whose end has a slit (83) for the introduction of an elastic metal blade (84). This blade (84) occupies, at rest (unbroken lines), a position parallel to the median axis (85). Due to the action of a magnet applied against the external surface of the device, this blade is deformed as shown by the broken lines, its free end separating from the center of the device.

The external housing (63) is made up of two complementary parts (87 and 88) to reduce the manufacturing costs. These complementary parts (87 and 88) are assembled by HF welding or bonding, after the clamp and its clamp support have been accommodated inside.

The housing has the general shape of a cylinder with conical end (90). This lower conical end (90) has an opening (91) whose section allows the placement on the neck of a bottle, but it is less than the section of the swelling of the neck plus the thickness of the opposite fingers (62,66) of the clamp (60).

This device also includes a spring (79) which rests, on the one hand, against the external surface of the disk-shaped bottom (77) of the clamp support (61) and, on the other hand, on the internal side of the housing (59). It is possible for the housing (59) to have an internal recess (95) into which an HF label (93) is placed. This recess is closed by a washer (93) whose internal surface has a recess (94) to receive the end of the spring (79).

The housing also has an internal shoulder (101) which is placed opposite the free end of the blade (84). This shoulder (101) ends in a projecting lip (102) which makes it possible to radially hold the free end of the blade (84) in the working position. The height of this lip (102) is small so as to allow the disengagement of the blade (84) by axial displacement of the housing with respect to the clamp support.

The operation of the device is as follows.

At rest, the spring (79) tends to push back the clamp (60) toward the opening (91) of the housing (59). The fingers (62–66) of the clamp are radially pushed toward the interior by the lower conical surface (100) of the housing. The protuberances (72–76) thus narrow the section of the device.

When the device rests against the neck of the bottle, the top edge pushes the clamp (60) back to the interior of the housing, which has the effect of allowing a radial separation of the protuberances (72–76) provided at the end of the fingers (62–66). The annular swelling of the neck of the bottle is then placed inside the clamp. It is then no longer possible to withdraw the device. If tension is applied to the housing, the only part accessible from the outside, the internal conical edge (100) of the bottom part of the housing comes to rest against the fingers (62–66) which tend to tighten the lower extremity of the clamps and further prevent the movement over the annular swelling. If pressure is applied to the external housing, it is sufficient to pull the device over the bottle.

To withdraw the device, one must apply pressure to the housing and bring a magnet close to the external surface of the housing. This has the effect of attracting the blade (84), against the internal wall of the housing. Since the housing is in a low position with respect to the clamps and the clamp support, the free end (103) of the blade passes above the lip (102). When one releases the pressure against the housing, the blade remains locked by the lip (102) in the working position, even if the magnet is withdrawn. If tension is then applied to the housing, the axial displacement of the clamps with respect to the housing is prevented by the blade (84), and the fingers remain in the open position. It is then possible to cause the swelling of the neck of the bottle to come out of the clamp.

The invention is described in the preceding description as a nonlimiting example. Naturally, a person skilled in the art can imagine various variants which reproduce the basic characteristics of the invention.

What is claimed is:

1. A theft preventing device for articles having an end which has a swelling and a central axis such as a bottle or a flask, said theft preventing device comprising:

an interior element having at least one protuberance directed toward the central axis, an external tubular element, said external tubular element being movable with respect to said interior element along the central axis between a position in which said interior element and said external tubular element work in cooperation to push back said protuberance in the direction of the central axis, and having an unlocked position in which said external tubular element releases said interior element to allow a radial separation of said protuberance; and a locking means having a radially movable metal blade to prevent the opening of the article without using a specific tool, wherein the tool unlocks said locking means by magnetically displacing said radially movable metal blade.

2. The theft preventing device according to claim 1, wherein said interior element and said external element work cooperatively with the surfaces, which are at least in part conical, ensuring the tightening of the part of the interior body located below the swelling of the neck when they are axially displaced in the locked position, and allowing the enlarging of said part when displaced in the opposite direction.

3. The theft preventing device according to claim 1, wherein said interior element comprises a tubular body having a bottom end and a part which is at least radially deformable, wherein said protuberance is at said bottom end.

4. The theft preventing device according to claim 3, wherein said interior element has an essentially tubular part, which is radially deformable and extended by longitudinal hooks having at their bottom end a protuberance directed toward the central axis.

5. The theft preventing device according to claim 3, wherein said interior element and said external element are locked when inserted into each other by a locking spring catch.

6. The theft preventing device according to claim 3, wherein said theft preventing device comprises an internal tubular element and an external tubular element, which can be moved with respect to each other, in rotation, and of a resisting band, of which one end is integrally connected to said external element and the other end is integrally connected to said interior element, said band forming a loop having a section which is greater than the annular swelling at rest, and which can be reduced by a relative rotation of said external element and said interior element.

7. The theft preventing device according to claim 6, wherein said external element and said interior element present complementary teeth which can prevent the rotation when said elements are in a position close to each other.

8. The theft preventing device according to claim 6, wherein said exterior element and said interior element are axially movable between a position which allows relative rotation and a position which prevents relative rotation.

9. The theft preventing device according to claim 8, wherein said external element and said interior element are unlocked by means of a spring catch.

* * * * *